United States Patent [19]

Hiraga et al.

[11] Patent Number: 4,862,432

[45] Date of Patent: Aug. 29, 1989

[54] SECURING CONSTRUCTION FOR TIMEPIECE

[75] Inventors: Imao Hiraga; Noriaki Shimura; Yojiro Okakura; Masaru Kubota, all of Shiojiri; Osamu Takashi, Suwa, all of Japan

[73] Assignees: Shiojiri Kagyo Kabushiki Kaisha, Nagano; Seiko Epson Corporation, Tokyo, both of Japan

[21] Appl. No.: 162,382

[22] PCT Filed: Apr. 22, 1987

[86] PCT No.: PCT/JP87/00258

§ 371 Date: Dec. 21, 1987

§ 102(e) Date: Dec. 21, 1987

[87] PCT Pub. No.: WO88/00727

PCT Pub. Date: Jan. 28, 1988

[30] Foreign Application Priority Data

Apr. 22, 1986 [JP] Japan ..... 61-060554[U]
Sep. 8, 1986 [JP] Japan ..... 61-137441[U]
Oct. 7, 1986 [JP] Japan ..... 61-154056[U]

[51] Int. Cl.[4] ..... G04C 23/02
[52] U.S. Cl. ..... 368/88
[58] Field of Search ..... 368/76, 80, 88, 157, 368/160, 220

[56] References Cited

U.S. PATENT DOCUMENTS 4,437,768 3/1984 Miyasaka ..... 368/88
4,453,833 6/1984 Saitoh ..... 368/88
4,555,184 1/1983 Fujimori ..... 368/88

FOREIGN PATENT DOCUMENTS 2549311 1/1985 France .
56-172784 12/1981 Japan .
57-28391 2/1982 Japan .
58-14622 3/1983 Japan .
58-132886 9/1983 Japan .
60-46087 4/1985 Japan .
61-26194 2/1986 Japan .
61-281990 12/1986 Japan .
62-75489 5/1987 Japan .
2075223 11/1981 United Kingdom .

*Primary Examiner*—Vit W. Miska
*Attorney, Agent, or Firm*—Blum Kaplan

[57] ABSTRACT

A timepiece construction member comprises a timepiece frame, trains, a motor, circuit member and so on. A supporting member for keeping and securing the timepiece construction member is made of a spring plate. The supporting member is engaged with the plate at the periphery thereof and as a result, the timepiece construction member is secured by a simple means. It is possible to provide a securing construction having a high reliability and a small number of members. Further, since the supporting member also serves as the other operating member such as a battery plus terminal, it is possible to provide a small sized securing construction for members. Furthermore, since the members of the timepiece are in contact with an elastic beam of the spring plate, the members of the timepiece can be secured stably.

3 Claims, 9 Drawing Sheets

SECURING CONSTRUCTION FOR TIMEPIECE

TECHNICAL FIELD

The present invention relates to a securing construction for timepieces, and more particularly, a construction of securing analogue electronic timepieces provided with frames, trains, motors, circuit members and the like.

BACKGROUND ART

It is known from prior arts that members of analogue timepieces are secured by screws.

FIG. 1 shows a construction for securing stators and coil blocks in a prior electronic timepiece. Guide screw pins 16 and 16' are driven in the opening of a plate 11 to be secured by an interference. A stator 12 and a coil block 13 are positioned at guide pins 16 and 16', and secured to the plate 11 by tightening screws 17 and 17'.

Further, as a construction for securing members of timepieces without utilizing screws, the securing construction utilizing heat caulking is known.

However, such a prior securing construction utilizing screws has the following problems:

(1) Screws and screw pins are required, so that cost-up occurs according to the increase of the members;

(2) The control of torque is not stabilized when screws are tightened in assembly, therefore, such a construction has a disadvantage that when the tightened torque is small, looseness of screws may occur and when the tightened torque is large, screws may be broken off.

(3) When a frame of a timepiece is made of a low strength material such as plastic, such a construction has disadvantages in quality or after-sale services, since the frames of the timepieces may be broken by driving the screw pins, or the frame of the timepiece may be broken or the fixing power of the screw pins may be reduced by secular change because some stress is always added to the frame due to the interference between the screw pins and frame. Next, with respect to the method for securing members in utilizing heat caulking, the following problems occur in the magnetic connecting portion between a core of a coil block and a stator, and an electroconductive portion.

(1) When a core of the coil block and the stator is in magnetically contacted with each other with heat caulking, a sufficient heat caulking is required in order to obtain a sufficient contact and a sufficient contact load between them. When the heat caulking is conducted by utilizing some jigs, it is difficult to control the sufficient contact and the contact load in view of the dimensional variation of respective members. As a result, an additional process for the heat caulking is required.

Further, in the heat caulking, it is difficult to give the contact load between the coil block and the stator. (As the reaction is always given to the plastic, the plastic is modified easily till the stress becomes zero by secular change. In particular, the plastic is modified easier under a high temperature.) Consequently, spaces are generated between the core of the coil block and the stator, and the property is inferior due to the reduction of the magnetic connection.

(2) With regard to an electric conductor, the same thing as the above is mentioned. Namely, it is necessary to always press the electric conductors toward each other under a contact load of at least 50g. However, as mentioned above, as the strees is always added to plastic, the heat calking portion is modified by secular change and there is danger that any problem such as incomplete conduction occurs in quality.

(3) When the coil block is brought in contact with the stator by only a heat caulking, it is not possible to give after-sale service at all, and as a result, a problem, occurs, for example, the value of the product is lost.

Thereupon, to eliminate the above problems, the object of the present invention is to provide a securing construction for an analogue timepiece wherein a plate, that is, a timepiece frame, is secured to a timepiece members supported by a supporting member without any screws, to decrease the number of the members, and to provide a low cost timepiece having a high quality and reliability.

DISCLOSURE OF INVENTION

Namely, a securing construction of timepieces in accordance with the present invention comprises timepiece constructing members having a frame of timepieces, trains, a motor, circuit members and so on, and supporting members for securing said timepiece constructing member, wherein said supporting member is made of elastic material and has an engaging portion which is engaged with a plurality of engaged portions positioned at the periphery of said timepiece frame. By such a construction, it is possible to reduce the number of the members and provide a high reliable securing construction.

Further, in accordance with an electronic timepiece having stators, magnetic flux, and coils wound around said magnetic core, said stator and said magnetic core are in contact with each other by a supporting member made of elastic plate, thereby making it possible to reduce the members and provide a securing construction having a high reliability and adaptable to reduced dimensions.

BEST MODE OF CARRYING OUT THE INVENTION

The present invention is explained in more detail with reference to the accompanying drawings.

Figure 1:
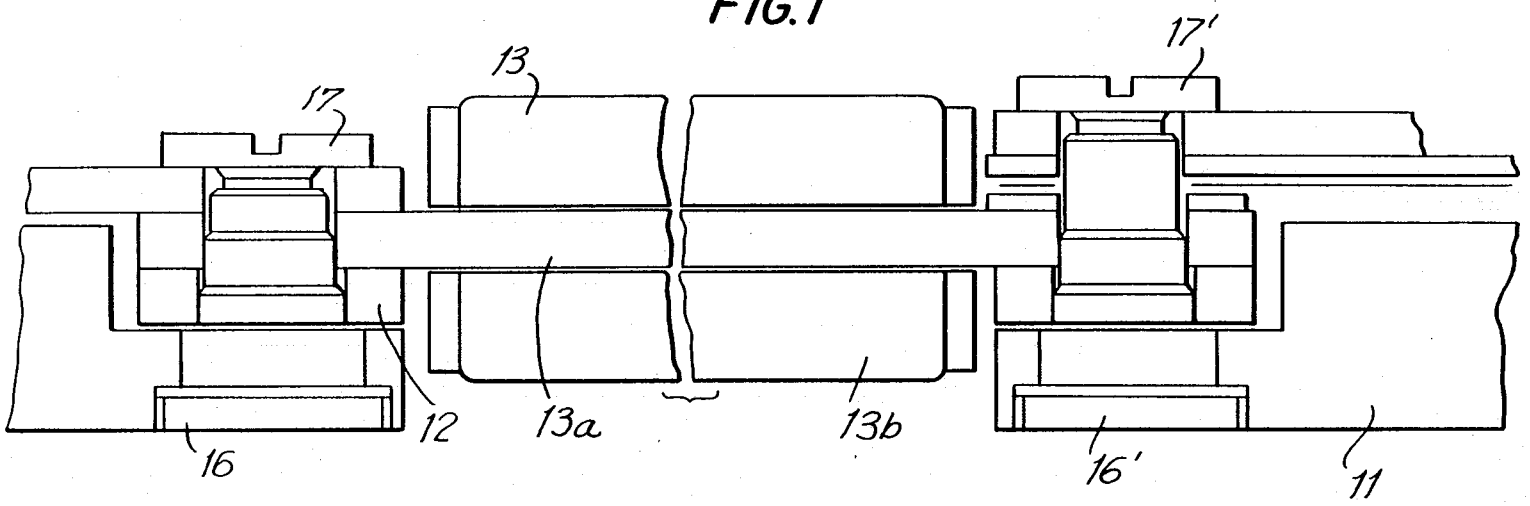
FIG. 1 is a sectional view which shows a securing construction for a prior timepiece.
Figure 2:
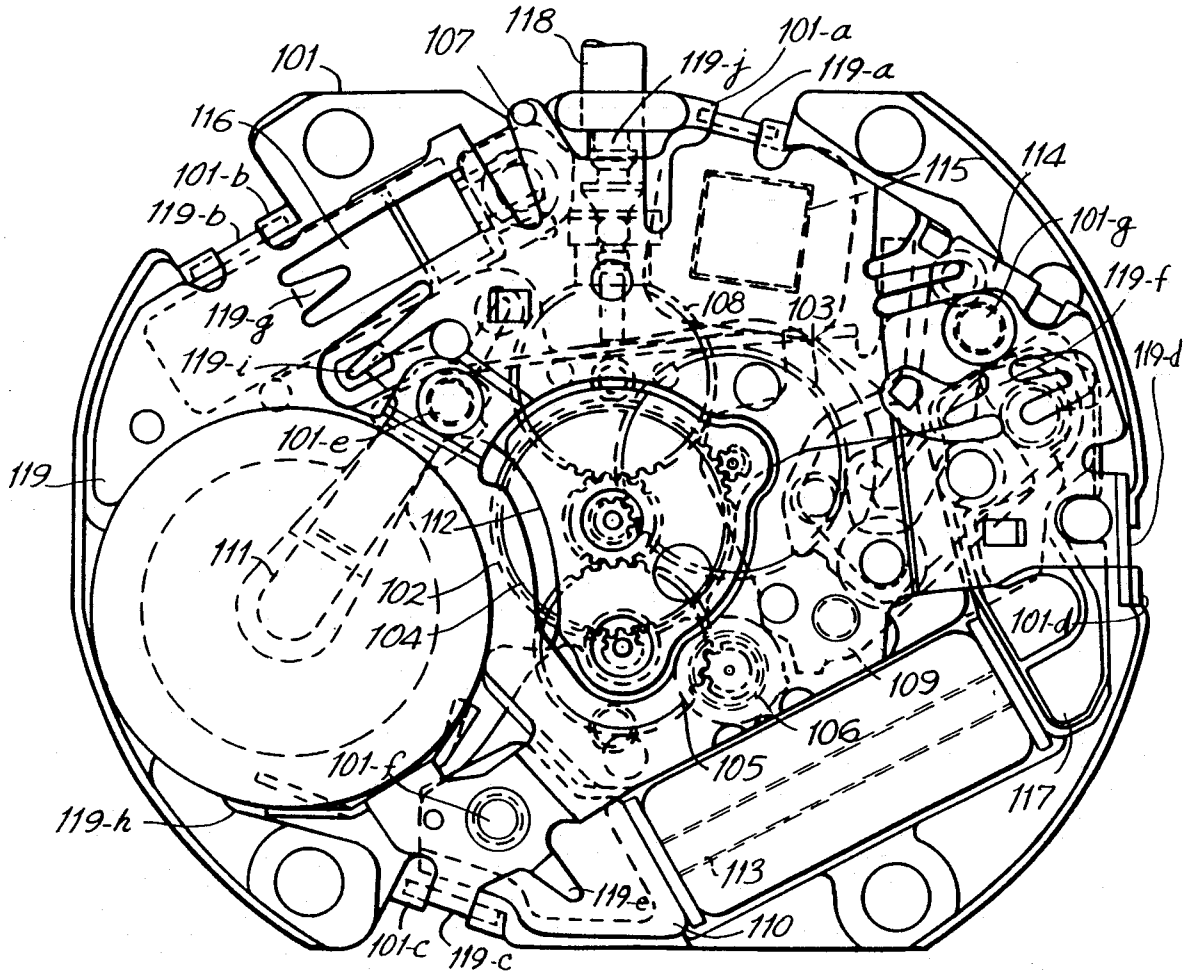
FIG. 2 is a plan view of a securing construction for a timepiece in accordance with the present invention.
Figure 3:
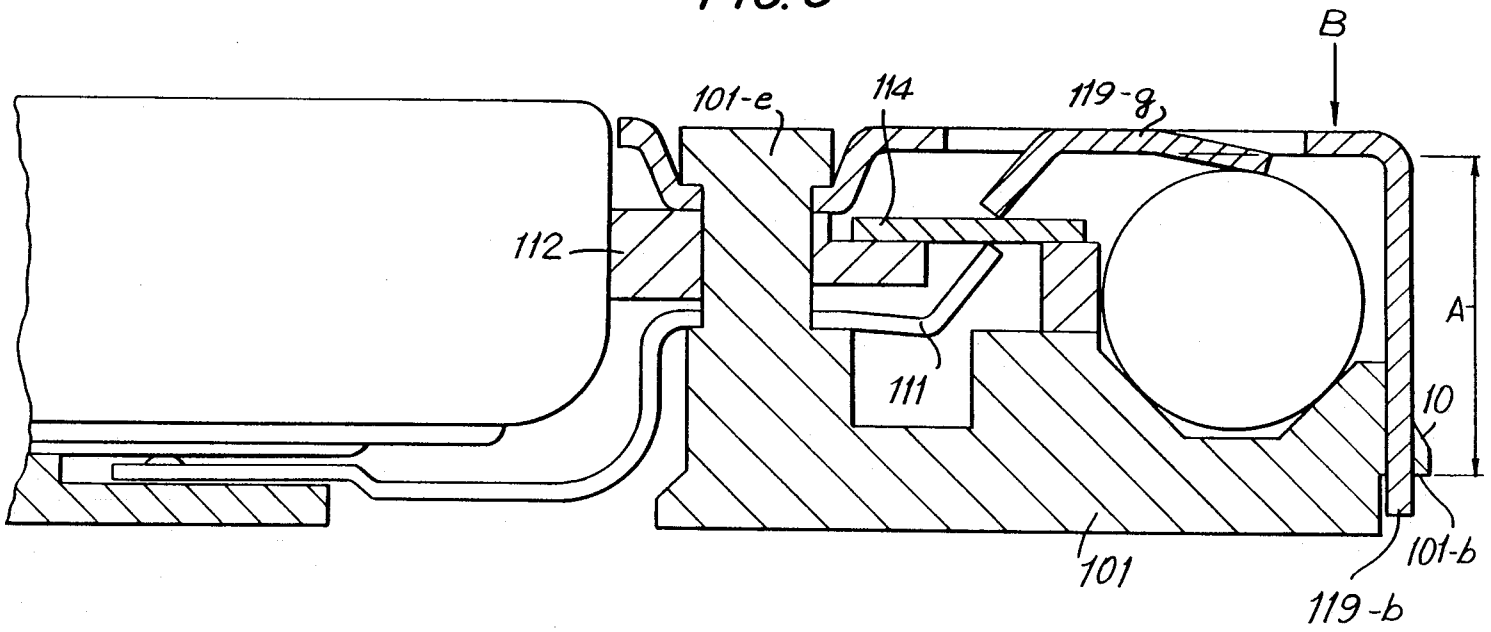
FIGS. 3, 4 and 5 are main parts of sectional view of FIG. 2, respectively.
Figure 4:
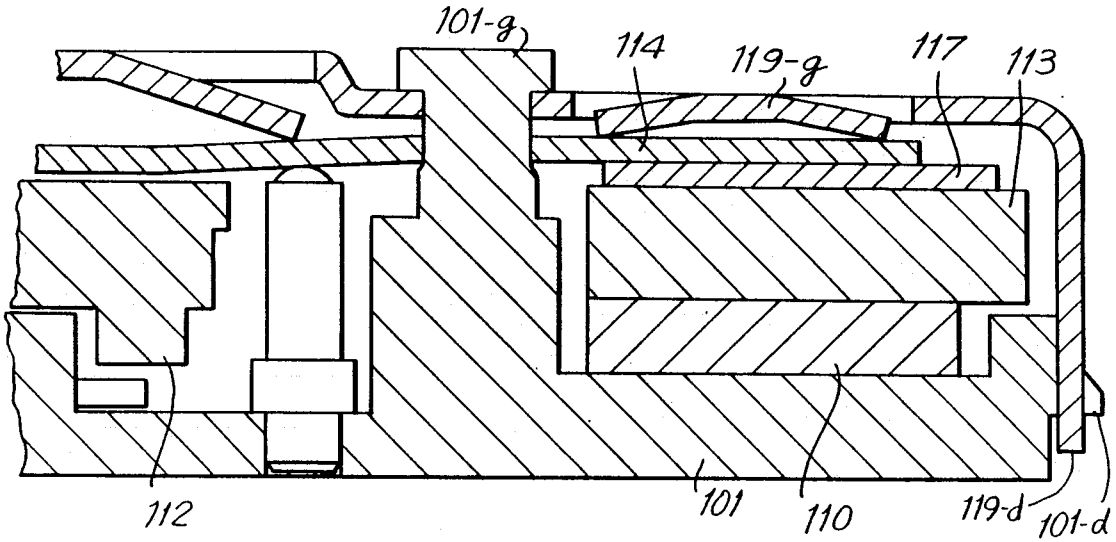
Figure 5:
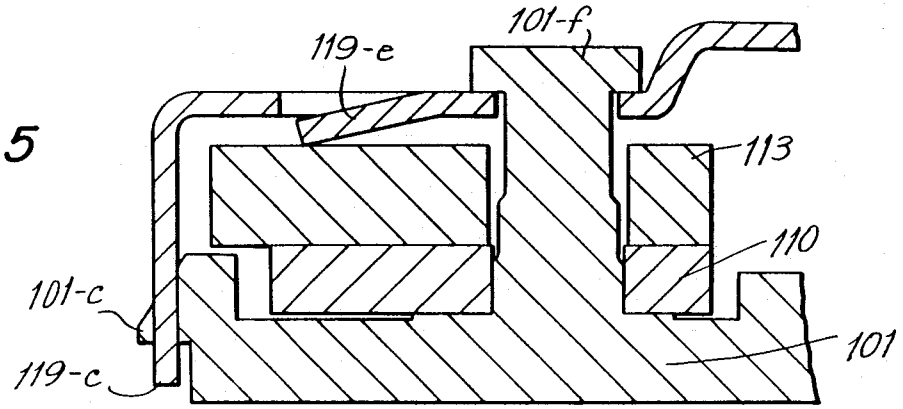

FIG. 2 is a plan view of the present invention. FIGS. 3, 4 and 5 are main parts of sectional views of FIG. 2. The reference numeral 101 is a frame of a timepiece, that is, a plate made of plastic material, which is provided to guide and support trains, motors, circuit members and the like described below. The plate has projecting portions 101-*a*, 101-*b*, 101-*c*, and 101-*d* in periphery thereof. The projecting portions are provided as an engaging portion in an supporting member, that is, a battery plus terminal described below. The reference numerals 102, 103, 104, 105, 106, 107 and 108 are a center wheel and pinion, a third wheel and pinion, a fourth wheel and pinion, a fifth wheel and pinion, a rotor, a clutch wheel and a minute wheel, respectively. The reference numeral 109 is a clutch plate and is provided to guide the lower pivot-pin of the third wheel with being guided by the plate. The reference numeral 110 is a stator and the reference numeral 111 is a battery minus terminal which are operated in a known way. The reference numeral 112 is a bridge member made of plastic material which is provided to guide and support the above mentioned respective members. The reference numeral 113 is a coil block which is provided to convert electric signals applied through the circuit block described below to magnetic energy. The coil block 113 is brought in contact with the stator, so that the rotor is rotated described above. The reference numeral 114 is a circuit block. A MOS-IC chip 115 and a quartz oscillator 116 are mounted on the circuit block 114. The circuit block 114 is electrically conducted to the battery minus terminal upon the contact of the battery minus terminal described above with the circuit block, and further electric signals are transmitted upon the contact of a coil lead substrate 117 of the coil block described above with the circuit block. The reference numeral 118 is a winding stem which serves as external operating member. All of the above mentioned members are guided and supported by the plate or the bridge member, but has no securing means.

The reference numeral 119 is a battery plus terminal which is provided to secure and support all of the above mentioned members and has the functions described below.

First, the battery plus terminal has portions 119-*a*, 119-*b*, 119-*c* and 119-*d* engaging with the projecting portions of the plate, which serves as a securing means of the members.

The reference numerals 119-*e*, 119-*f* and 119-*g* are made of elastic members, respectively. The reference numeral 119-*e* is a output terminal portion of the stator and the coil block. The reference numeral 119-*f* is an output terminal portion of the stator and the coil block, and of the coil lead substrate and the circuit pattern. The reference numeral 119-*g* is provided to press the quartz case. The reference numeral 119-*h* is an electrically contacting elastic portion which is in contact with the side of the battery. The reference numeral 119-*i* is a plus conductive elastic portion which is provided to conduct the plus potential to the circuit block by a uniform contacting pressure, as the plus conductive elastic portion is in contact with the above circuit block pattern.

Next, the assembly of the battery plus terminal is explained below.

The battery plus terminal is guided by plate guide shafts 101-*e*, 101-*f* and 101-*g*. The engaging portions 119-*a* and 119-*d* between the battery plus terminal and the projecting portion of the plate are assembled along the slanting surface of the projecting portion. The timepiece members supported by the plate and the battery plus terminal, the engaging portion of the battery plus terminal, and the variety of the bended height are absorbed by the elastic member positioned near the engaging portion.

Namely, the engaging portion of the battery plus terminal is pushed down excessively by an assembling means like a jig or the like and is assembled from the measure A shown in FIG. 3 (toward the direction of the arrow B in FIG. 2), thereby the engaging portion 119*b* of the battery plus terminal is engaged with the projecting portion 101*b* of the plate easily to be guided. The reference numeral 101*h* is a slanting surface for assembly. When the battery plus terminal is under the pushed condition, the engaging portion 119*b* is extended along the slanting surface 101*h* and after passing the slanting portion, the engaging portion 119*b* is assembled at the engaging portion by the spring power itself. When the battery plus terminal is released from the pressed condition, it is possible to give a uniform contact load to the above mentioned members by the elastic force of the elastic portion. The engaging portions 101 and 101*d* may be engaged with the projecting portion of the plate formed in a known T-shape or hole type.

In addition, the head portions of the plate guide shafts 101-*e*, 101-*f* and 101-*g* are melted down by heat caulking. Further, the guide shafts and the projecting portions of the plate receive the reaction of the battery plus terminals.

Such a securing construction utilizing a battery plus terminal does not require screws or screw pins and further, since the elastic portions metal members are in contact with each other, the contacting pressure is kept uniform irrespective of the variety of time, so that the reliability of the quality becomes high.

Furthermore, since the reaction of the elastic portion of the battery plus terminal is always added to the projecting portion of the plate made of plastic material, thereby there may be fear of the change of the configuration or crack, but as apparent from the drawings, since the sufficient thickness is kept easily in plane and sectional direction, therefore, it is possible to obtain two times or more strength, compared with the prior strength of the heat caulking of the plastic shaft provided with the plate.

As shown in FIGS. 3–5, since the projecting portion of the plate and the heat caulking portion of the plate guide shaft receive the reaction of the battery plus, it is possible to keep the strength and increase the reliability of the quality.

When the after-sale service is required, it is possible to exchange the members by cutting away the heat caulking portion of plastic. As mentioned above, even if the heat caulking is not conducted, any problem does not occur. Therefore, in accordance with the present invention, it is possible to eliminate the problem, that is, the replacement of the members is impossible in the prior securing construction of a timepiece utilizing the heat caulking.

In the above embodiment, since the elastic portion of the battery plus terminal is provided near the portion meshing with the projecting portion of the plate of the battery plus terminal, it is a matter of course that the elastic portion is in the position requiring the contact load in function, that is, the closer the contact portion of the stator and the coil block are positioned to the engaging portion of the timepiece, the more advantageous they are operated.

Further, in the present invention, the battery plus terminal is utilized as the means for securing timepieces, but in addition to the battery plus terminal, a simple timepiece securing member without electroconductive means may be utilized. Further, it is described in the present invention, that the engaged portion of the plate has a projecting shape, but it is a matter of course that there is no problem in function even if the engaged portion has a projecting portion and the engaging portion has a projecting portion.

Figure 6:
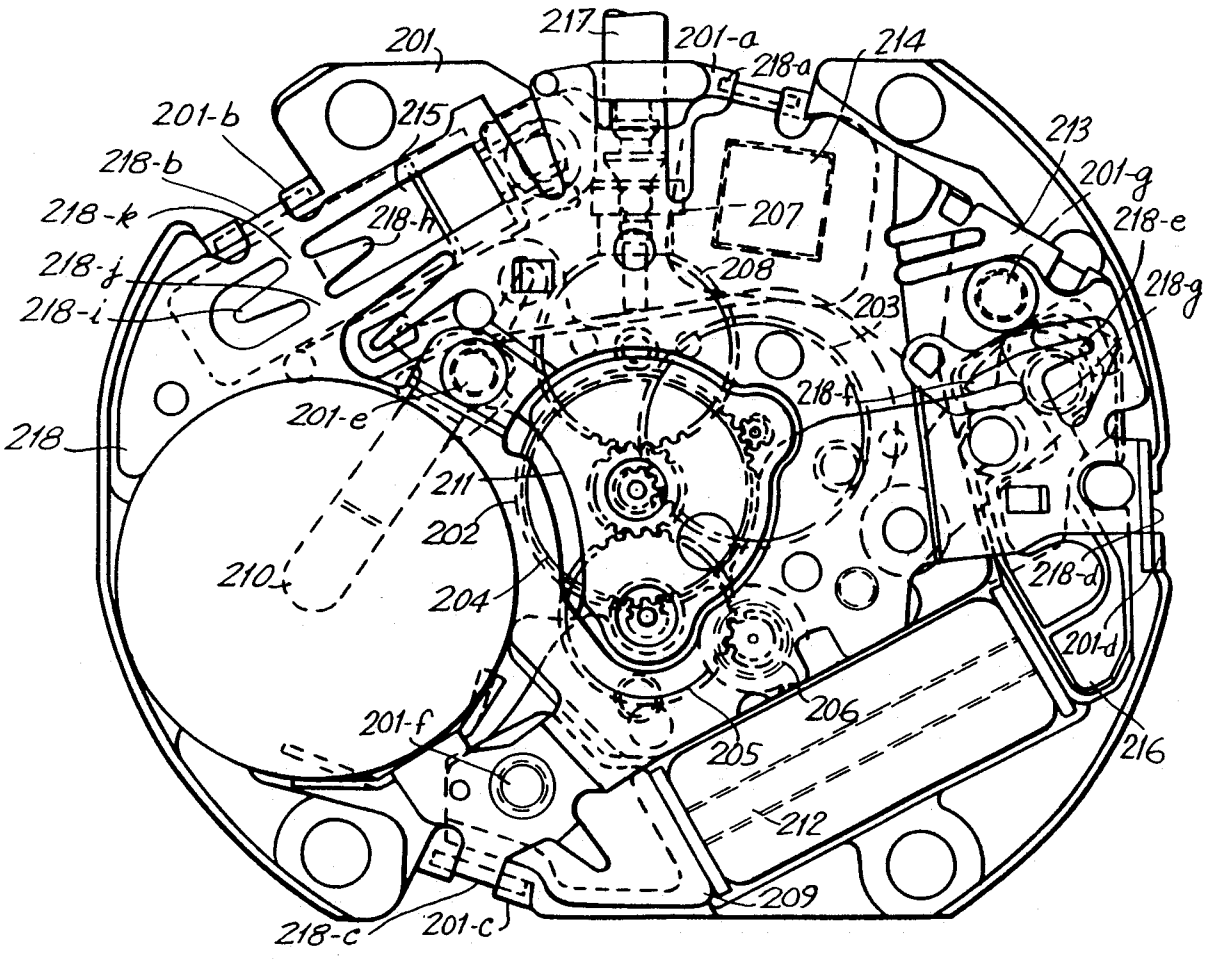
FIG. 6 is a plan view in accordance with the other embodiment of the present invention.
Figure 7:
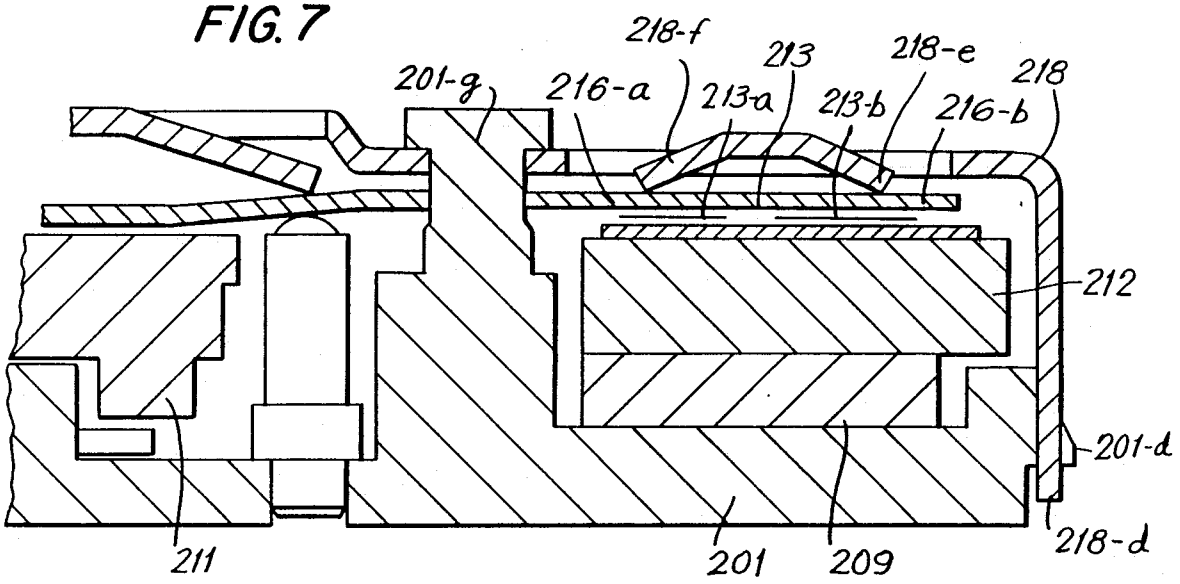
FIGS. 7 and 8 are main parts of sectional view of FIG. 6, respectively.
Figure 8:
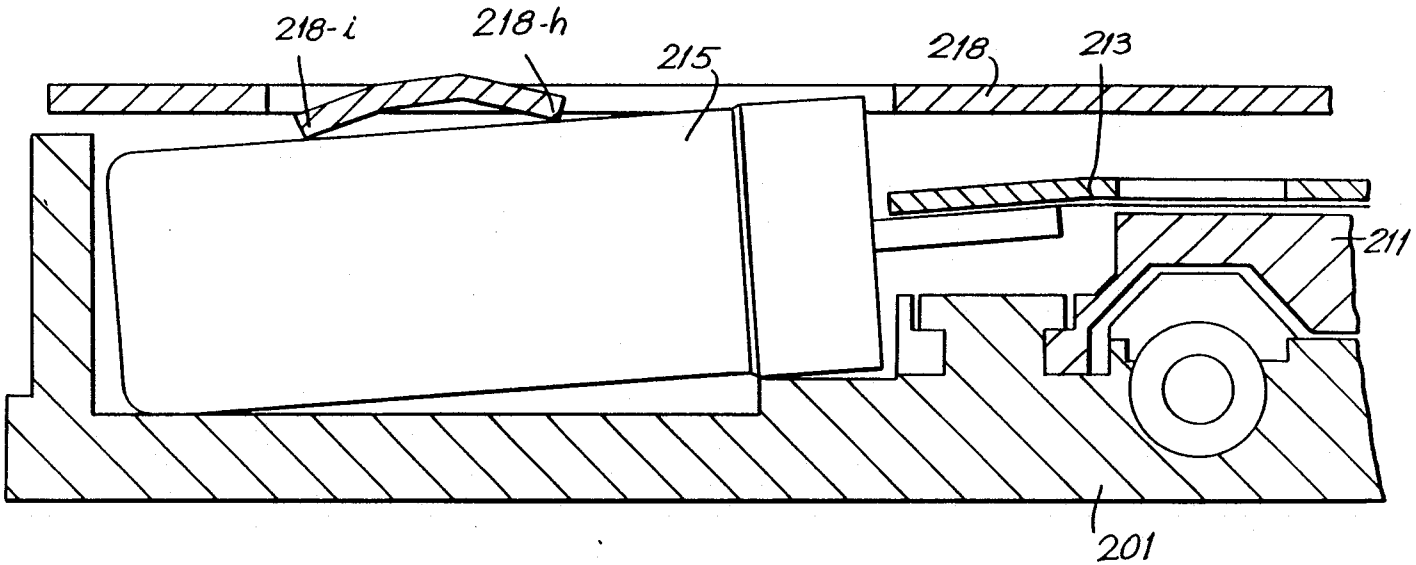

The other embodiment is explained below with reference to the drawings. FIG. 6 is a plan view of the other embodiment in accordance with the present invention. FIGS. 7 and 8 are main parts of the sectional view of FIG. 6.

The reference numeral 201 represents a plate, that is a frame of a analogue timepiece which is made of plastic material and is provided to guide and support trains, a motor, circuit members and so on (described below). Projecting portions 201-*a*, 201-*b*, 201-*c*, and 201-*d* are provided at the periphery portions of the plate to be engaged with a battery plus terminal serving as a supporting member (described below). The reference numerals 202, 203, 204, 205, 206, 207, 208 are a center wheel and pinion, a third wheel and opinion, a fourth wheel and pinion, fifth wheel and pinion, a rotor, a clutch wheel and a minute wheel, respectively. The reference numeral 209 is a stator and the reference numeral 210 is a battery minus terminal which are operated in a known way. The reference numeral 211 represents a bridge member which is provided to guide and support the above mentioned members.

The reference numeral 212 is a coil block. The coil block 212 is provided to convert the electric signal applied through the circuit block described below to magnetic energy and to rotate the above mentioned rotor 206, upon the contact of the coil block 212 with the stator 209. The reference numeral 213 is a circuit block on which MOS-IC chip 214 and a quartz oscillator 215 are mounted. Upon the contact of the circuit block 14 with the battery minus terminal, they are electrically conducted to each other. Further, upon the contact of the coil lead substrate of the coil block with the circuit block 114, electric signals are transmitted therebetween. The reference numeral 217 is a winding stem which serves as an external operating member.

The reference numeral 218 is a battery plus terminal which is provided to secure and press the above all members and has the functions described below. The battery plus terminal 218 has portions 218*a*, 218*b*, 218*c* and 218*d* engaging with the projecting portion of the plate, serves as means for securing members and is guided by the guide shafts 201-*e*, 201-*f* and 201*g* to be secured by heat caulking.

The reference numerals 218-*e* and 218-*f* are spring portions which are substantially symmetrical and have an equal constant of spring. The center portion of the respective spring portions are supported by a spring beam 218-*g*. FIG. 7 shows a sectional view of the spring portion in detail. Spring portions 218-*e* and 218-*f* are constructed so as to conduct $0_1$, $0_2$ of patterns 213-*a*, 213-*b* of circuit substrate 213 to $0_1$, $0_2$ of patterns 216-*a*, 216-*b* of the coil lead substrate 216, respectively under a pressed condition. Further, the spring portions also serves for magnetically connecting the coil block 212 with the stator 209 as a motor under a pressed condition.

The spring portions 218-*e* and 218-*f* are supported by the elastic beam 218*g* at the center portion thereof. The beam allows to be twisted, thereby the both springs are slidably movable. Even if the contacting pressure of the output conductive terminals $0_1$ and $0_2$ is not uniform in height by the irregular height of the heat caulked portions or the irregularity of the respective members, curvature of the plate and so on, the both spring portions enable to add an equal pressure to the respective patterns. Further, it is possible to stabilize the pressure force at the magnetic connecting portion between the above mentioned coil block 212 and the stator 209 as a motor.

The quartz oscillator is secured in the same way. The spring portions 218-*h* and 218-*i* have a symmetry shape and an equal spring constant. The center portion of them is supported by the both end supporting beams 218-*j* and 218-*k*. As shown in FIG. 8, the quartz oscillator is disposed obliquely in view of the construction of the circuit substrate 213. In the same way as that of the above mentioned output conductive portion of the coil, the both springs 218-*h* and 218-*i* are supported at the center portion thereof. Although the quartz oscillator 215 is disposed obliquely, it is supported under a substantial uniform pressure by the both springs 218-*f* and 218-*i* due to the function of elastic supporting beams 218-*j* and 218-*k* which are moved twistedly and slidably, thereby it is possible to secure the quartz oscillator securely.

In the embodiment of the present invention, a battery plus terminal is utilized as a securing member, but even if the other securing member is utilized, the same effects can be obtained.

Figure 9:
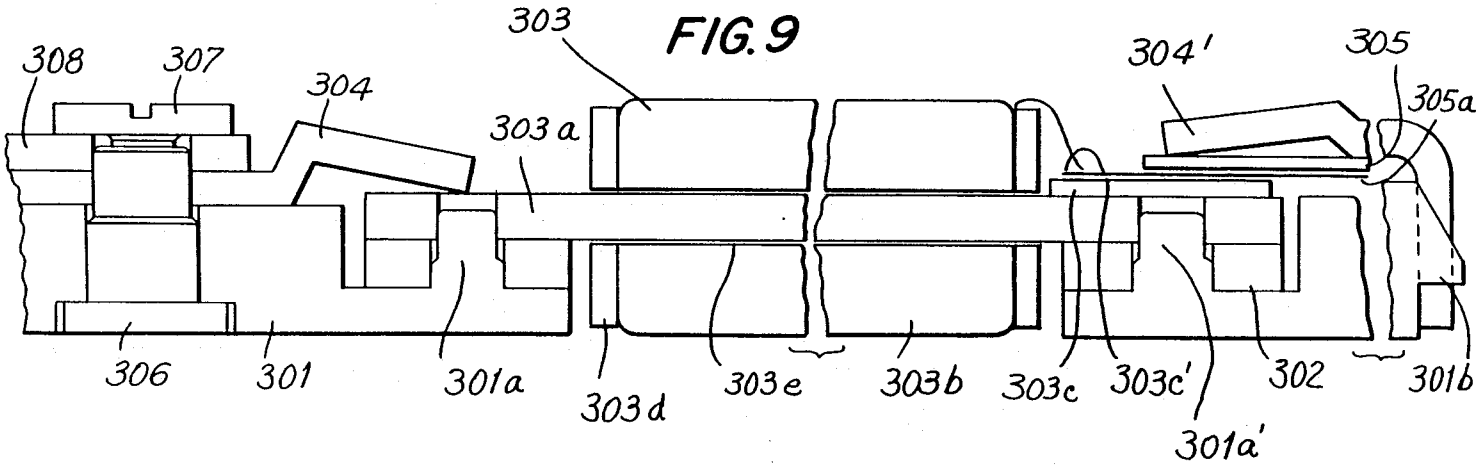
FIG. 9 is a sectional view of a securing construction for a timepiece in accordance with the other embodiment of the present invention.

FIG. 9 shows a sectional view of one embodiment according to the present invention. A plate 301 is made of engineering plastic and is formed integrally with dowels 301*a*, 301*a*′ and a projection 301*b*. A guide pin 306 is secured. A stator 302 is guided by dowels 301*a* and 301*a*′. A magnetic core 303*a* is also guided by dowels 301*a* and 301*a*′ and is piled up on the stator 302. A coil lead substrate 303*c* is adhered at one side of the magnetic core 303*a*. A coil 303*b* is wound around a magnetic core 303*a* through an insulating member 303*e*. The both ends of the coil 303*b* is in adhesively contact with respective copper foil portions 303*c*′on the coil lead substrate 303*c*. A coil frame 303*d* is secured to a magnetic core 303*a*.

As mentioned above, the coil block 303 is constructed by the magnetic core 303*a*, a coil 303*b*, a coil lead substrate 303*c*, a coil frame 303*d* and an insulating member 303*e*. A circuit substrate 305 is piled up on the coil lead substrate 303*c*. The respective coper foils 303*c*′ on the coil lead substrate 303*c* is in contact with the coper foil 305*a* which is connected to the output terminal of MOS-IC mounted on the circuit substrate 305 (not shown). In the side of the coil lead substrate 303*c*, the coper foil portion 303*c*′ of the coil lead substrate 303*c* is conducted to the coper foil portion 305*a* of the circuit substrate 305 by the spring force of the motor supporting spring 304′, thereby the stator 302 and the magnetic core 303*a* are under the pressed condition. On the opposite side of the coil lead substrate 303*c* of the coil block 303, the stator 302 and the magnetic core 303*a* are pressed down by the motor supporting spring 304. The magnetic supporting spring 304 is secured together with a bridge member 308 by a guide receiver 306 for securing the bridge member 308 and a fixing screw 307. The motor supporting spring 304′ is secured by engaging with the projection 301*b* extending from a side of the substrate 311.

Figure 10:
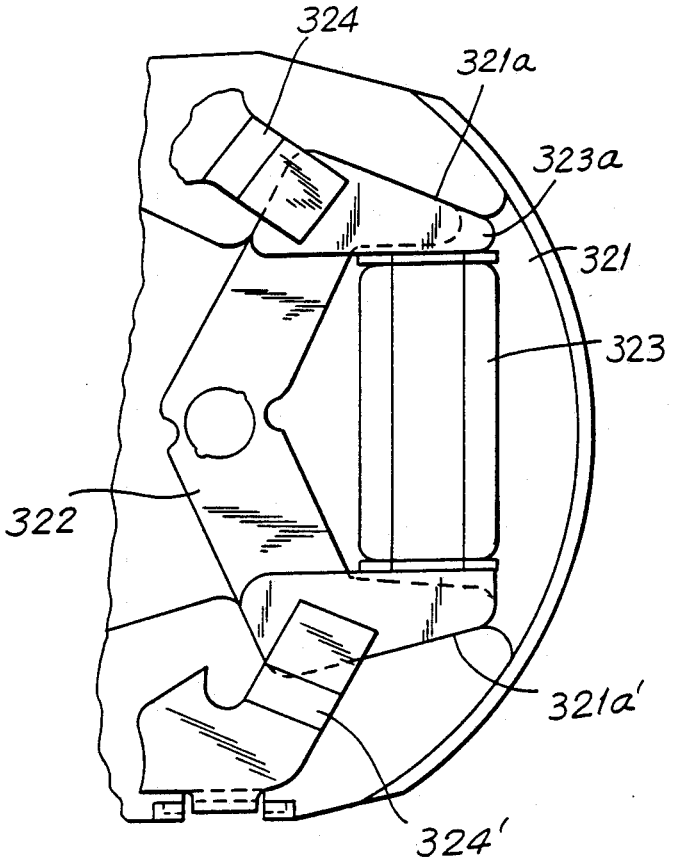
FIG. 10 is a plan view according to the other embodiment of the present invention.

In FIG. 9, the motor supporting spring 304 is secured by a screw and the motor supporting spring 304 is secured by engaging with the projection 301*b*. However, the other securing method may be utilized, for example, the both of them may be secured by screws, or may be secured by the engaging with the projection, or may be secured by the same screws. FIG. 10 is a plan view of the other embodiment according to the present invention and shows a securing construction of only a stator 322 and a coil block 323. The stator 322 and the coil block 323 are guided by the plate 321 having recess portions 321*a* and 321*a'* and are secured by motor supporting springs 324 and 324'. In this case, the stator 322 and the magnetic core 323*a* have not guide holes, therefore the contact area between the stator 322 and the magnetic core 323*a* is increased, thereby making it possible to increase the property of the motor. On the contrary, it is possible to make the external shape of the contact portion smaller without reducing the contact area, and possible to reduce the size of the moving plan surface. Therefore, in the present invention, it is possible to reduce the contact space and to provide a guide construction most suitable to a small-sized timepiece.

In the present invention, it is described that a guide dowel or recess portions of the plate which is formed integrally with the plate made of engineering plastic is utilized to be guided. However, even if a metal plate is utilized, the same effects can be obtained.

What is claimed is:

1. A securing construction for an analog timepiece including a motor for driving a display, comprising a timepiece construction member including a timepiece frame, trains, a motor, at least one circuit member and a supporting member for securing and supporting said timepiece construction member, said motor including a stator mounted on said timepiece frame, magnetic cores mounted on said stator, magnetic coils surrounding said magnetic cores, and a coil lead substrate mounted on said magnetic cores wherein said supporting member is an elastic plate having elastic beams and engaging projections, and said engaging projections being securely engaged with a plurality of cooperating receiving portions disposed at the periphery portion of said timepiece frame and at least one of said elastic beams pressing said coil lead substrate to press said circuit member and bring said circuit member in electrical contact with said coil lead substrate and securing said magnetic core and stator and acting to support the remainder of said timepiece construction member.

2. (2) A securing construction as claimed in claim 1, wherein said supporting has an elastic portion near an engaging portion of the timepiece frame, and said timepiece construction member is pressed and secured by the reaction of said elastic portion.

3. (3) A securing construction as claimed in claim 1, wherein said supporting member has at least a spring portion which is supported by an elastic beam to the twisted or shifted and has a substantially symmetrical shape respective to the elastic beam in right and left, and further, said timepiece construction member is secured to both ends of said spring portion under pressure partially or entirely.

* * * * *